US009555539B2

(12) United States Patent
Lin

(10) Patent No.: US 9,555,539 B2
(45) Date of Patent: Jan. 31, 2017

(54) TOOL BOX WITH RUBBER PERIPHERAL FENCES

(71) Applicant: I-N-B International Inc., Taichung (TW)

(72) Inventor: Yi-Hung Lin, Taichung (TW)

(73) Assignee: I-N-B INTERNATIONAL INC., Taichung (TW)

( * ) Notice: Subject to any disclaimer, the term of this patent is extended or adjusted under 35 U.S.C. 154(b) by 13 days.

(21) Appl. No.: 14/726,427

(22) Filed: May 29, 2015

(65) Prior Publication Data

US 2016/0346915 A1 Dec. 1, 2016

(51) Int. Cl.
*B25H 3/02* (2006.01)

(52) U.S. Cl.
CPC ..... *B25H 3/02* (2013.01)

(58) Field of Classification Search
CPC ..... B25H 3/00; B25H 3/02; B65D 17/34; B65D 43/04; B65D 43/16; B65D 51/04; B65D 81/02
USPC ..... 206/373, 372; 220/4.22, 4.23, 810, 833, 220/843, 844
See application file for complete search history.

(56) References Cited

U.S. PATENT DOCUMENTS

| | | | | | |
|---|---|---|---|---|---|
| 2,014,951 | A * | 9/1935 | Rathbun | E05D 1/04 | 220/843 |
| 2,347,980 | A * | 5/1944 | Apfelbaum | E05D 9/005 | 220/844 |
| 3,628,843 | A * | 12/1971 | Wynne | B25H 3/02 | 206/373 |
| 4,836,374 | A * | 6/1989 | Hutchins | A45C 3/00 | 206/373 |
| 7,089,627 | B2 * | 8/2006 | Seidler | B65D 51/04 | 220/4.22 |
| 8,646,601 | B2 * | 2/2014 | Green | B25H 3/003 | 206/373 |
| 2015/0239631 | A1 * | 8/2015 | Kinskey | B65D 81/02 | 220/4.22 |

* cited by examiner

*Primary Examiner* — Bryon Gehman

(57) ABSTRACT

A tool box contains: a holder, a cover, a first peripheral fence, and a second peripheral fence. The holder includes a first abutting rib extending upwardly from a top end of a peripheral wall thereof. The cover is used for covering the holder, and between the holder and the cover is defined an accommodating space to accommodate tools. The first peripheral fence is arranged around the peripheral wall of the holder. The second peripheral fence is arranged around an outer wall of the cover and includes a contacting face extending inwardly from a bottom end of the second peripheral fence to contact with the first abutting rib of the holder.

5 Claims, 8 Drawing Sheets

TOOL BOX WITH RUBBER PERIPHERAL FENCES

FIELD OF THE INVENTION

The present invention relates to a tool box which contains a second contacting face of a second peripheral fence to contact with a first abutting rib of a holder, thus covering a cover on the holder tightly.

BACKGROUND OF THE INVENTION

A conventional tool box is employed to accommodate a variety of tools (such as wrenches, sockets, and screwdrivers, etc.). With reference to FIGS. 1 and 2, a conventional tool box 10 contains a holder 11 and a cover 12 which are made of plastic material, wherein the holder 11 has an accommodating space for accommodating various tools and has a connection member 13 disposed on one side thereof to connect with the cover 12, such that the cover 12 is rotatably covered on the accommodating space of the holder 11. The holder 11 also has a shoulder 111 arranged on a peripheral side thereof, and the cover 12 has a rib 121 for corresponding to the shoulder 111 of the holder 11, such that when the cover 12 is covered on the holder 11, the shoulder 111 of the holder 11 retains with the rib 121 of the cover 12. However, the conventional tool box still has disadvantage as follows:

1. When the shoulder 111 of the holder 11 retains with the shoulder 121 of the cover 12, a gap produces between the shoulder 111 and the rib 121, so the cover 12 cannot cover the holder 11 completely, and then dusts, waters or moistures enter into the accommodating space of the holder 11 to damage or corrode the tool box severely.

The holder 11 and the cover 12 of the tool box 10 are made of the plastic material, accordingly when the tool box 10 drops on the ground or crashes an object, the holder 11 and the cover 12 are destroyed by an impact force, thus reducing a service life of the tool box 10.

The present invention has arisen to mitigate and/or obviate the afore-described disadvantages.

SUMMARY OF THE INVENTION

The primary objective of the present invention is to provide a tool box which contains a holder and a cover for covering the holder, wherein between the holder and the cover is defined an accommodating space to accommodate tools, the holder further includes a first abutting rib extending upwardly from a top end of a peripheral wall thereof, and the holder includes a first peripheral fence arranged around the peripheral wall thereof and made of flexible material; the cover includes a second peripheral fence arranged around an outer wall thereof and made of flexible material, and the second peripheral fence has a second contacting face extending inwardly from a bottom end thereof to contact with the first abutting rib of the holder, thus covering a cover on the holder tightly.

Another objective of the present invention is to provide a tool box which contains a holder and a cover for covering the holder, wherein the holder includes the first peripheral fence arranged around the peripheral wall thereof and made of flexible material, and the cover includes the second peripheral fence arranged around the outer wall thereof and made of flexible material, such that when the tool box drops on the ground or crashes an object, an impact force is absorbed by the holder and the cover, thereby prolonging a service life of the tool box.

DETAILED DESCRIPTION OF THE PREFERRED EMBODIMENTS

Figure 1:
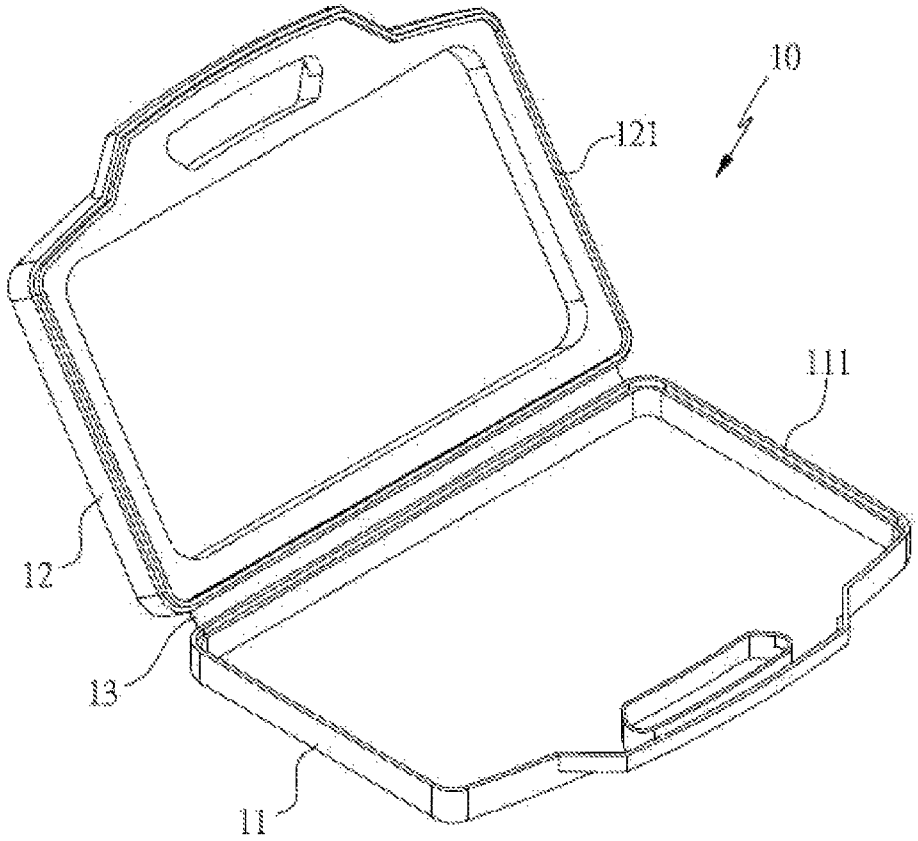
Fig. 1 Prior Art
FIG. 1 is a perspective view of a conventional tool box.
Figure 2:
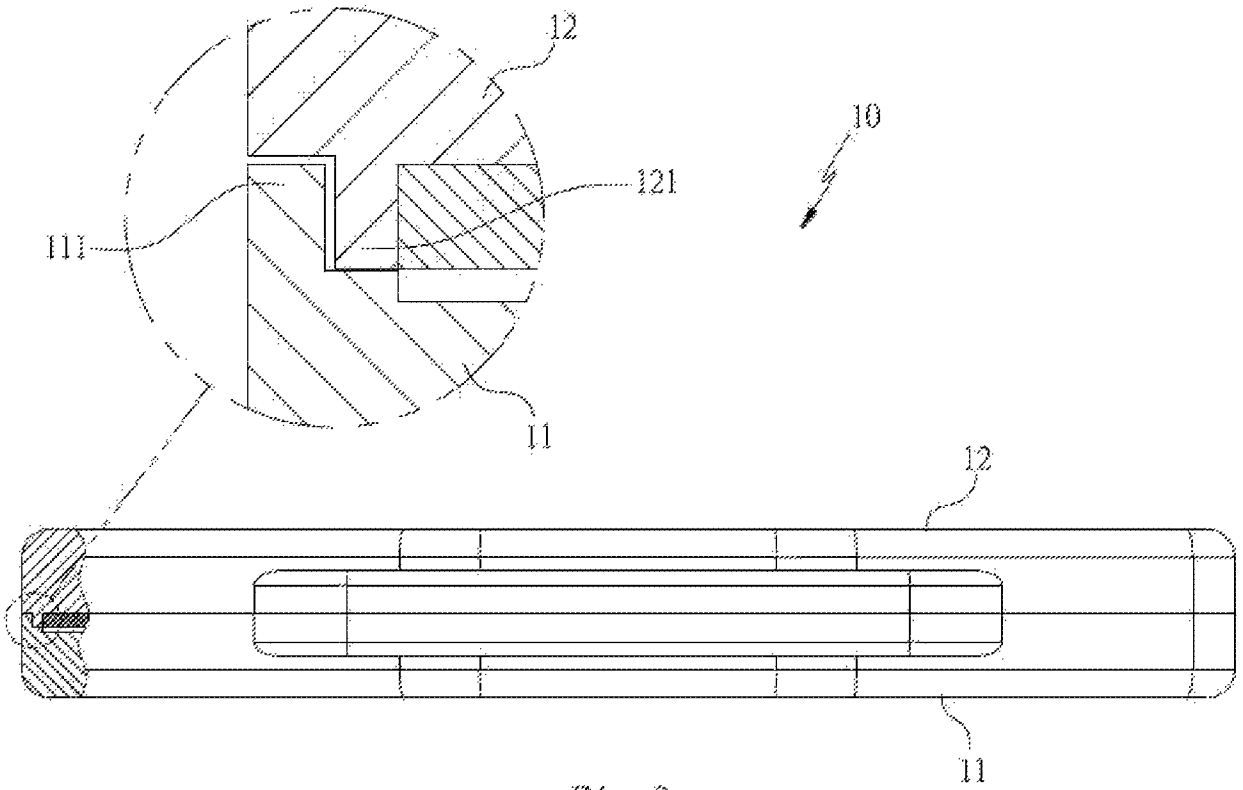
Fig. 2 Prior Art
FIG. 2 is a cross sectional view of the conventional tool box.
Figure 3:
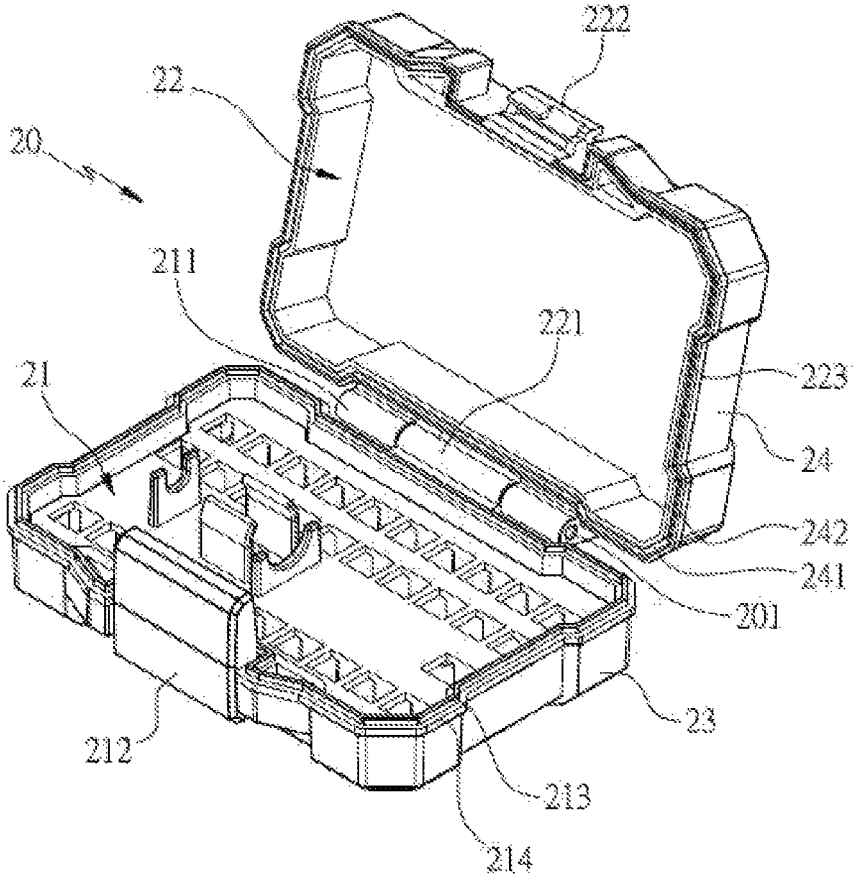
FIG. 3 is a perspective view showing the assembly of a tool box according to a preferred embodiment of the present invention.
Figure 4:
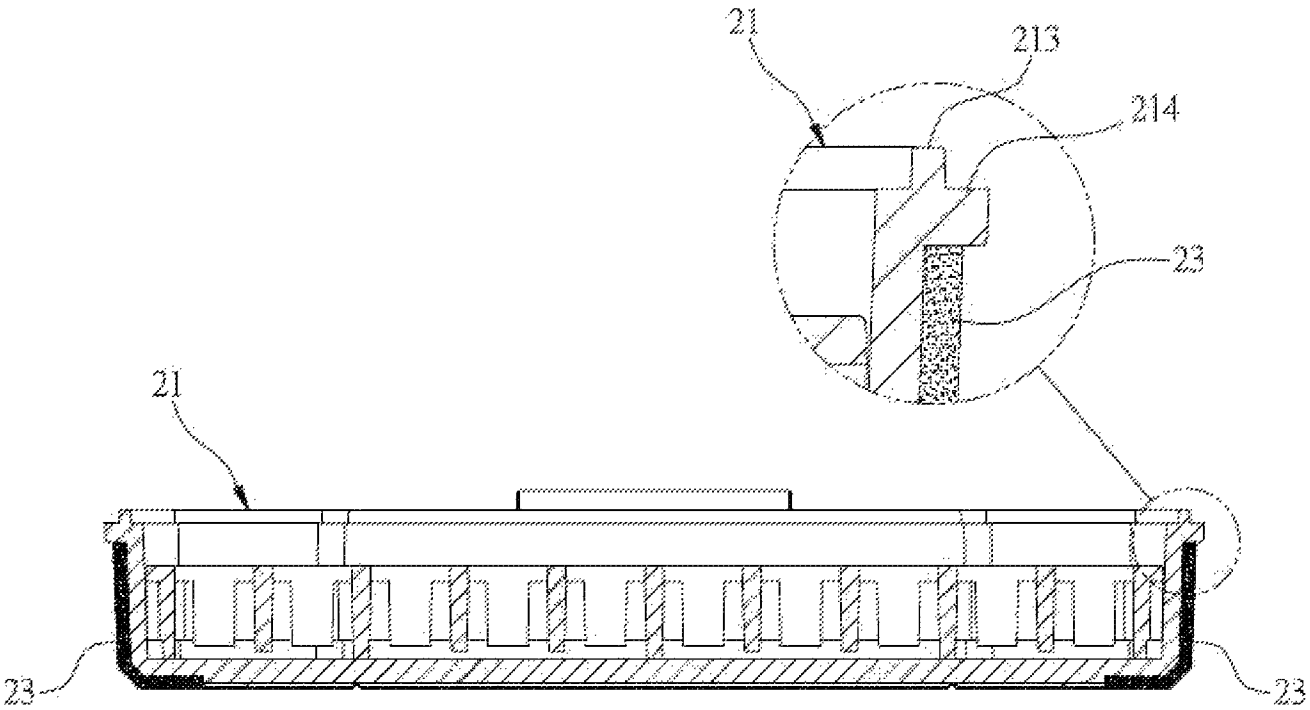
FIG. 4 is a cross sectional view showing the assembly of the tool box according to the preferred embodiment of the present invention.
Figure 5:
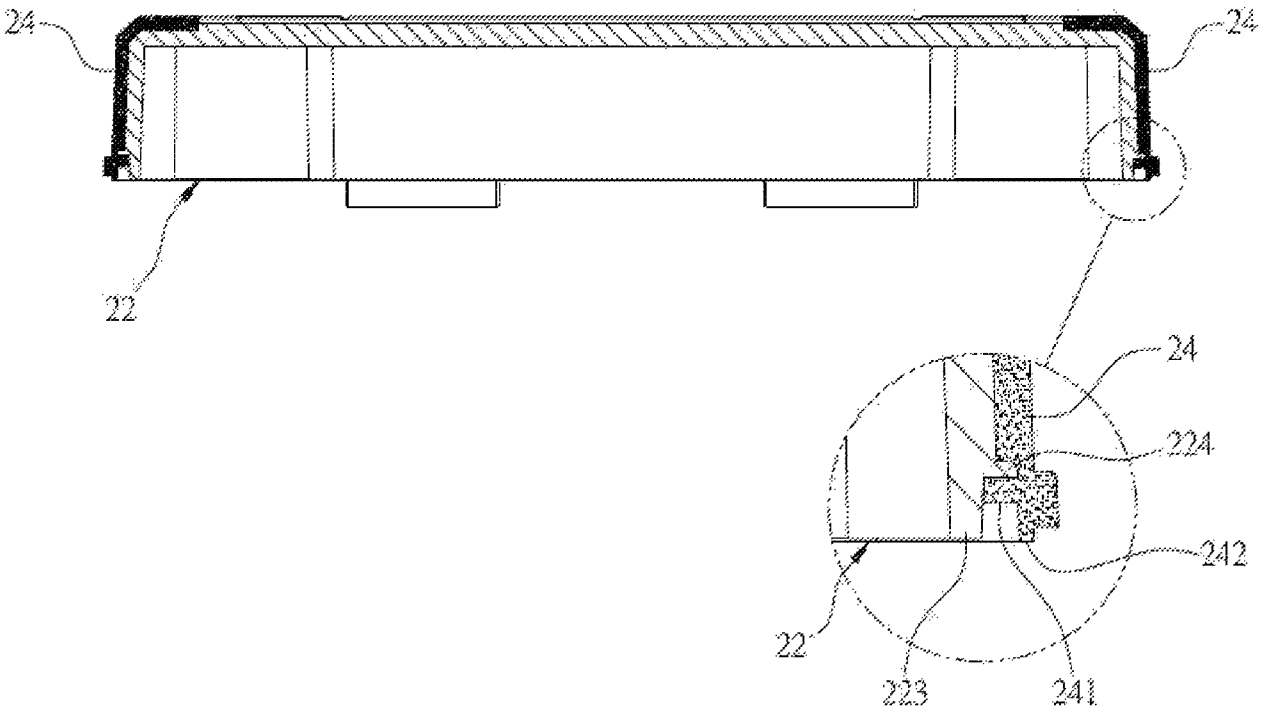
FIG. 5 is a cross sectional view showing the assembly of a part of the tool box according to the preferred embodiment of the present invention.
Figure 6:
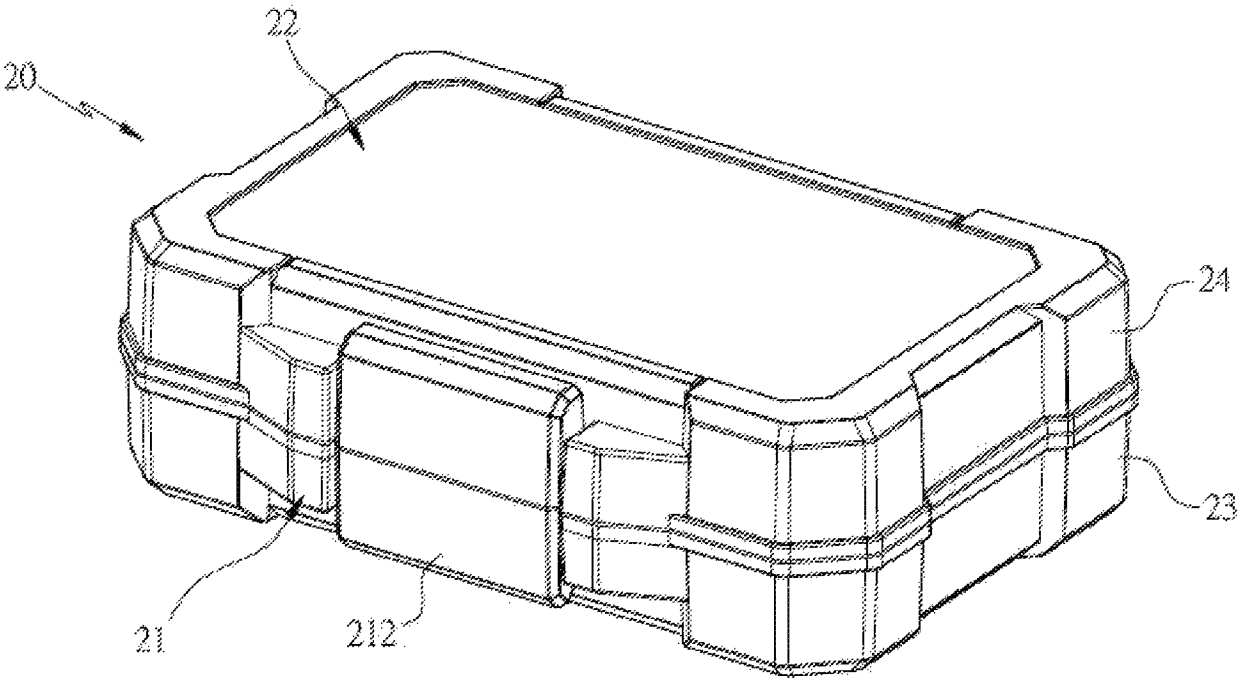
FIG. 6 is a perspective view showing the operation of the tool box according to the preferred embodiment of the present invention.
Figure 7:
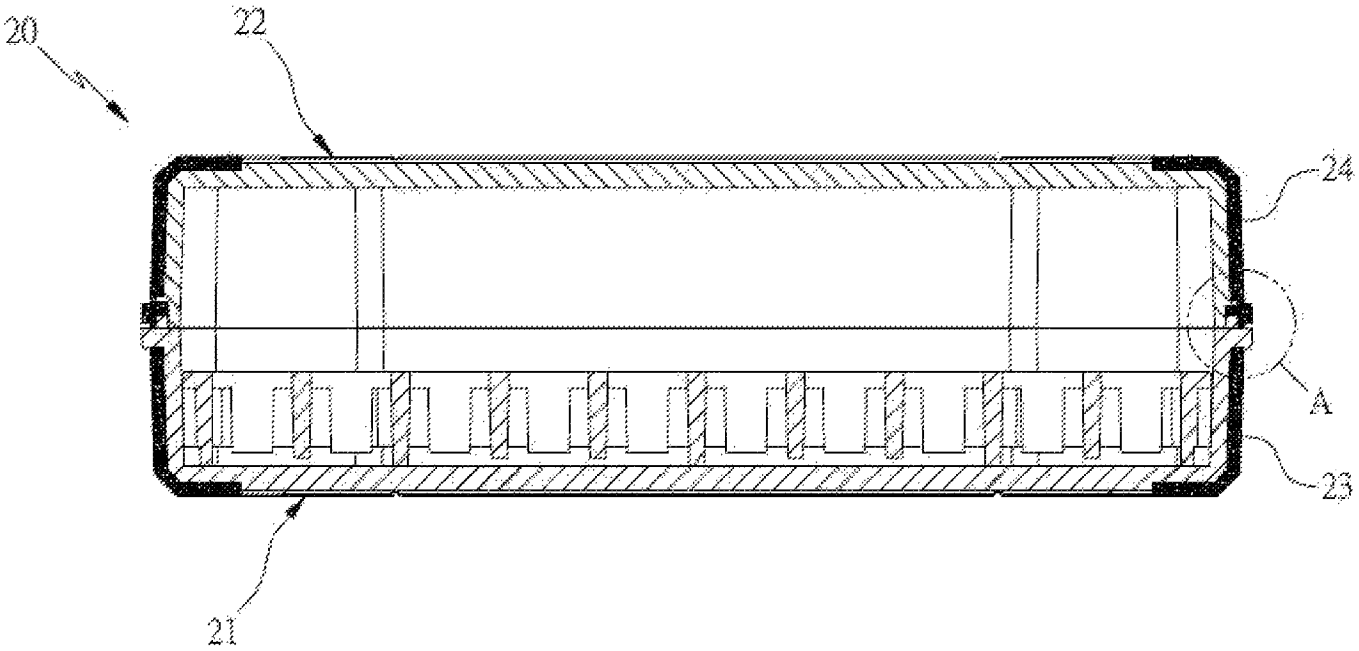
FIG. 7 is a cross sectional view showing the operation of the tool box according to the preferred embodiment of the present invention.
Figure 8:
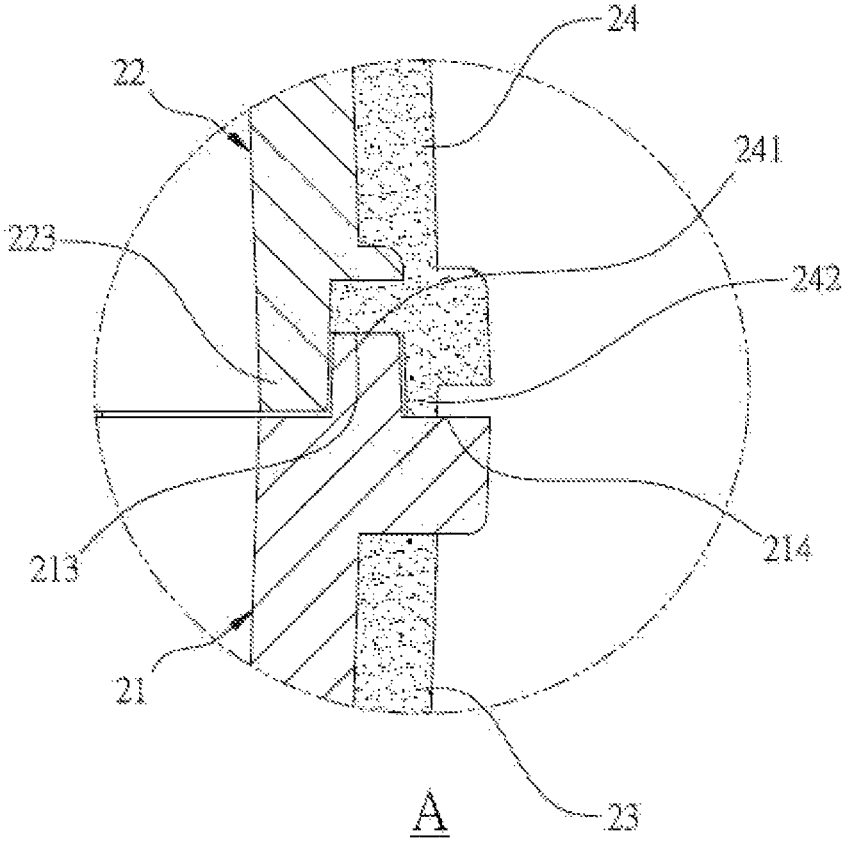
FIG. 8 is a cross sectional view showing the operation of a part of the tool box according to the preferred embodiment of the present invention.

With reference to FIGS. 3 to 5, a tool box 20 according to a preferred embodiment comprises: a holder 21 and a cover 22 for covering the holder 21, wherein between the holder 21 and the cover 22 is defined an accommodating space to accommodate tools. In this embodiment, the holder 21 and the cover 22 are rotatably connected together by ways of a connection structure, and the connection structure is defined between the holder 21 and the cover 22 and includes a first rotatable connecting portion 211 disposed on a rear end of the holder 21, a second rotatable connecting portion 221 mounted on a rear end of the cover 22, and a joining shaft 201 inserted into the first rotatable connecting portion 211 of the holder 21 and the second rotatable connecting portion 221 of the cover 22, such that the cover 22 is rotatably covered on or is uncovered from the holder 21 along the joining shaft 201. Between the holder 21 and the cover 22 is also defined a locking structure to lock the holder 21 and the cover 22 together, wherein the locking structure includes a first retainer 212 mounted on a front end of the holder 21, a second retainer 222 secured on a front end of the cover 22, such that the first retainer 212 of the holder 21 retains with the second retainer 222 of the cover 22, thus locking the holder 21 and the cover 22 together. The holder 21 further includes a first abutting rib 213 extending upwardly from a top end of a peripheral wall thereof, a first contacting face 214 formed around the top end of the peripheral wall thereof outside the first abutting rib 213, and a first peripheral fence 23 arranged around the peripheral wall thereof and made of flexible material (such as rubber). The cover 22 further includes a shoulder 223 extending downwardly from a bottom end thereof and contacting with the first abutting rib 213 of the holder 21, a second peripheral fence 24 arranged around an outer wall of thereof and made of flexible material (such as rubber), a second contacting face 241 extending inwardly from a bottom end of the second peripheral fence 24 to contact with the first abutting rib 213 of the holder 21, a second abutting rib 242 extending downwardly from the bottom end of the second peripheral fence 24 to contact with the first contacting face 214 of the holder 21, and an engaging protrusion 224 extending outwardly from the outer wall thereof, such that the second peripheral fence 24 wraps the outer wall of the cover 22 securely.

Referring to FIGS. 3 and 6 to 8, in operation, the first retainer 212 of the holder 21 is retained with the second retainer 222 of the cover 22, such that the cover 22 covers the holder 21. Thereafter, the second contacting face 241 of the second peripheral fence 24 of the cover 22 contacts with the first abutting rib 213 of the holder 21, the second abutting rib 242 of the second peripheral fence 24 contacts with the first contacting face 214 of the holder 21, thus eliminating a gap around the accommodating space between the holder 21 and the cover 22 to cover the cover 22 on the holder 21 tightly. When the tool box 20 drops on a ground or crashes an object, an impact force is absorbed by the holder 21 and the cover 22, thereby prolonging a service life of the tool box 20.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool box comprising:

a holder including a first abutting rib extending upwardly from a top end of a peripheral wall of the holder;

a cover for covering the holder, and between the holder and the cover being defined an accommodating space to accommodate tools;

a first peripheral fence arranged around the peripheral wall of the holder;

a second peripheral fence arranged around an outer wall of the cover and including a contacting face extending inwardly from a bottom end of the second peripheral fence to contact with the first abutting rib of the holder;

wherein the holder further includes a first contacting face formed around the top end of the peripheral wall thereof outside the first abutting rib, and the second peripheral fence has a second abutting rib extending downwardly from the bottom end thereof to contact with the first contacting face of the holder; and wherein each of the first peripheral fence and the second peripheral fence is made of rubber.

2. The tool box as claimed in claim 1, wherein between the holder and the cover is defined a connection structure, and the connection structure includes a first rotatable connecting portion disposed on a rear end of the holder, a second rotatable connecting portion mounted on a rear end of the cover, and a joining shaft inserted into the first rotatable connecting portion of the holder and the second rotatable connecting portion of the cover, such that the cover is rotatably covered on or is uncovered from the holder along the joining shaft.

3. The tool box as claimed in claim 1, wherein between the holder and the cover is also defined a locking structure to lock the holder and the cover together, wherein the locking structure includes a first retainer mounted on a front end of the holder, a second retainer secured on a front end of the cover, such that the first retainer of the holder retains with the second retainer of the cover.

4. The tool box as claimed in claim 1, wherein the cover further includes a shoulder extending downwardly from a bottom end thereof and contacting with the first abutting rib of the holder.

5. The tool box as claimed in claim 1, wherein the cover further includes an engaging protrusion extending outwardly from the outer wall thereof, such that the second peripheral fence wraps the outer wall of the cover.

* * * * *